United States Patent [19]

Akashi

[11] 4,238,872

[45] Dec. 16, 1980

[54] SEPARABLE SLIDE FASTENER CHAIN AND A METHOD OF PRODUCING THE SAME

[75] Inventor: Shunji Akashi, Kurobe, Japan

[73] Assignee: Yoshida Kogyo K.K., Tokyo, Japan

[21] Appl. No.: 82,621

[22] Filed: Oct. 9, 1979

[30] Foreign Application Priority Data

Oct. 11, 1978 [JP] Japan ..... 53-124940

[51] Int. Cl.[3] ..... A44B 19/36

[52] U.S. Cl. ..... 24/205.11 F; 156/66

[58] Field of Search ..... 24/205.11 R, 205.11 F; 156/66, 23.1

[56] References Cited

U.S. PATENT DOCUMENTS

| | | | |
|---|---|---|---|
| Re. 25,935 | 12/1965 | Porepp | 24/205.11 F X |
| 3,263,291 | 8/1966 | Taylor | 24/205.11 F |
| 3,353,233 | 11/1967 | Frölich | 24/205.11 F |
| 3,490,970 | 1/1970 | Heimberger | 156/66 |
| 3,510,379 | 5/1970 | Heimberger | 24/205.11 F |
| 3,554,822 | 1/1971 | Schwarzkopf | 156/66 |
| 3,892,017 | 7/1975 | Watson | 24/205.11 F |
| 3,895,418 | 7/1975 | Ebata | 24/205.11 F |
| 3,999,255 | 12/1976 | Warburton et al. | 24/205.11 F X |

*Primary Examiner*—Roy D. Frazier
*Assistant Examiner*—Peter A. Aschenbrenner
*Attorney, Agent, or Firm*—Robert E. Burns; Emmanuel J. Lobato; Bruce L. Adams

[57] ABSTRACT

A separable slide fastener chain comprises a pair of oppositely disposed stringers of continuous length each having a support tape and a fastener element formed from a plastic monofilament into a continuous structure secured by sewn seams to a longitudinal inner edge of the respective tape. The fastener element is fused together over a predetermined length of the two coupled stringers at predetermined intervals. A composite pin-forming structure is located centrally of the fused length of the fastener element and cut out to produce a multi-form aperture having a pair of bay portions extending transversely of the fastener chain and oppositely disposed in point-symmetry relation and a pair of elongated canal portions extending longitudinally closely along the sewn seams. The composite structure is subdivisible across the bay portions into two identical pairs of slider-lock pin members and inserting pin members.

4 Claims, 13 Drawing Figures

SEPARABLE SLIDE FASTENER CHAIN AND A METHOD OF PRODUCING THE SAME

BACKGROUND OF THE INVENTION

1. Field of the Invention

This invention relates to slide fastener stringers having a continuous length (commonly known as "fastener chains") and a method of making the same for use as a separable type of slide fastener.

2. Prior Art

There are known two typical forms of the so-called separable slide fastener, one of which has a pin member on one stringer releasably engageable with a socket or box member on the other stringer at one end of the fastener, and the other has two sliders oppositely oriented so as to permit the fastener to be opened reversibly from both ends of the fastener.

Such conventional separable fasteners are usually provided at the upper ends thereof with end stops and at the lower ends thereof with pin members, socket members or slider-lock members depending upon the particular purpose for which the fastener is used. The various members attached at the lower end of the separable fastener would necessarily restrict the form and application to which the fastener can adapt itself. It has been difficult according to the prior art teachings to provide for example a "loop" fastener using a single fastener stringer.

SUMMARY OF THE INVENTION

It is therefore a primary object of this invention to provide a slide fastener chain of continuous length which can be readily applied to either a separable slide fastener or a loop fastener.

It is another object of the invention to provide a method of making a slide fastener chain of the aforesaid character which is very simple and efficient.

A more specific object of the invention is to provide a pair of continuous length fastener stringers having a slider-lock pin member and an inserting pin member formed simultaneously in point-symmetry relation at predetermined intervals.

According to the invention, there is provided a separable slide fastener chain comprising a pair of oppositely disposed stringers of continuous length each having a support tape and a fastener element formed from a plastic monofilament into a continuous structure having coupling head portions and secured by sewn seams to a longitudinal inner edge of the respective tape, said fastener element being fused together over a predetermined length of the two coupled stringers at predetermined intervals, and a composite pin-forming structure located centrally of the fused length of the fastener element and cut out to produce a multi-form aperture having a pair of bay portions extending transversely of the fastener chain and oppositely disposed in point-symmetry relation and a pair of elongated canal portions extending longitudinally closely along the sewn seams, said composite structure being subdivisible across said bay portions into two identical pairs of slider-lock pin members and inserting pin members.

These and other related objects and features of the invention will become manifest to those versed in the art by referring to the detailed description which follows with reference o the accompanying drawings.

DETAILED DESCRIPTION OF THE PREFERRED EMBODIMENTS

Figure 2:
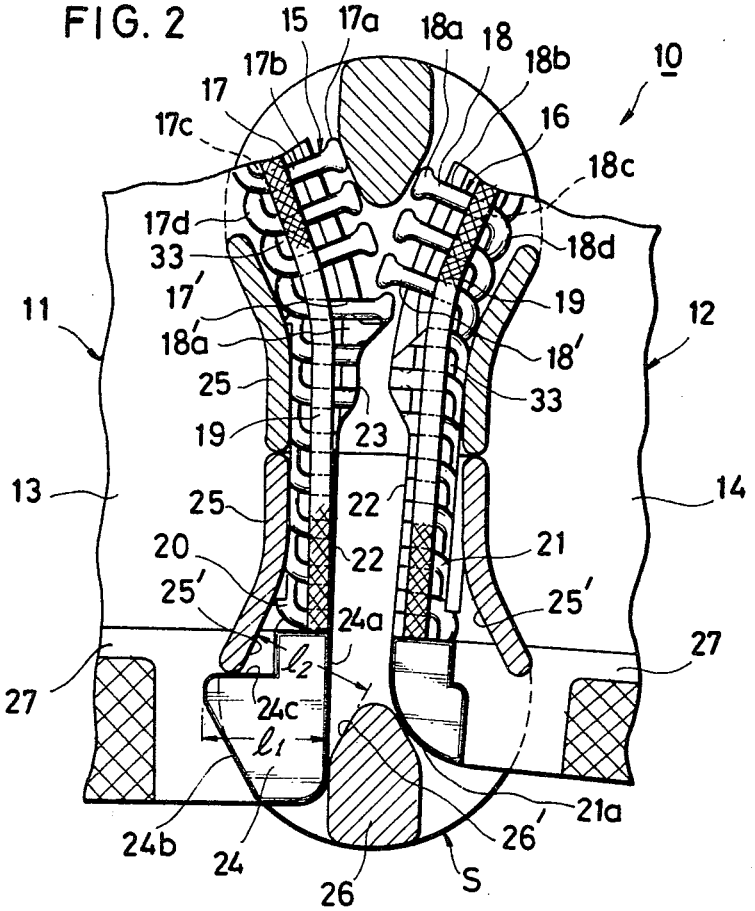
FIG. 2 is a fragmentary plan view, on enlarged scale, of a pair of slide fastener stringers according to the invention with two oppositely directed sliders mounted thereon.

Referring now to the drawings and FIG. 2 in particular, there is shown for purposes of illustration an important portion of a separable slide fastener 10 provided in accordance with the principles of the invention. The fastener 10 comprises a pair of oppositely disposed stringers 11, 12 each having a support tape 13,(14) and a row of interlocking fastener elements 15,(16) mounted on and along a longitudinal inner edge of the respective tape. The fastener element 15,(16) is formed from a plastic monofilament into a continuous coil or meandering structure, the element 15,(16) being shown in the illustrated embodiment to be a helically coiled structure consisting of a succession of elongated convolutions or loops 17,(18) each having a coupling head portion 17*a*,(18*a*) at one end thereof, an upper leg 17*b*,(18*b*), a lower leg portion 17*c*,(18*c*) extending from the head 17*a*,(18*a*) in a common direction and a connecting heel or turn portion 17*d*,(18*d*) at the opposite end remote from the head 17*a*,(18*a*) connected to a next adjacent one of the successive loops 17,(18).

Figure 1:
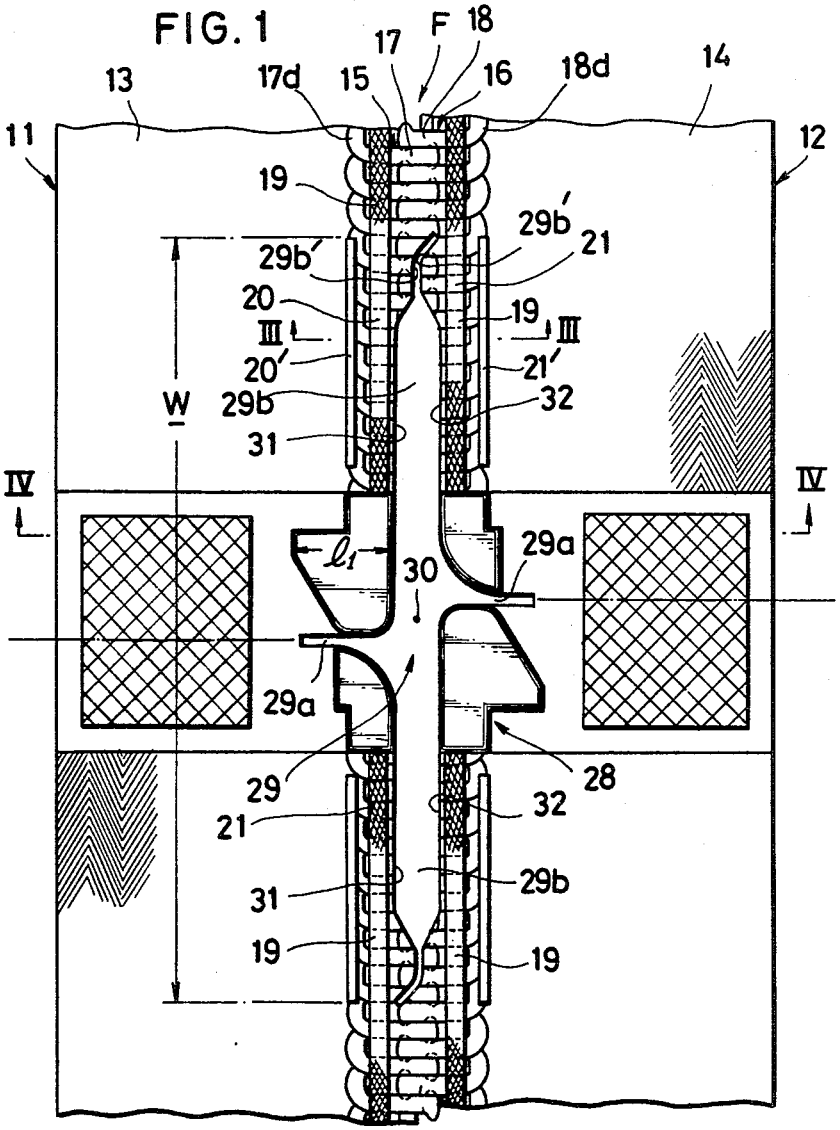
FIG. 1 is a fragmentary plan view of a fastener chain provided in accordance with the invention.

The coupling head 17*a* of the loop 17 on one stringer 11 is dimensioned to releasably couple with the corresponding head 18*a* of the loop 18 on a mating stringer 12 to open and close the fastener 10 in the well-known manner. The upper and lower legs 17*b*,17*c* and 18*b*,18*c* are spaced apart in substantially superimposed relation to each other as shown in FIG. 1 and define therebetween a longitudinally extending "tunnel" or hollow conduit through which a reinforcing string, cord or core 33 is inserted. Designated at 19 is a sewn seam or stitching securing the row of loops 17,(18) to the respective tape 13,(14).

In accordance with the principles of the invention, the successive loops 17,(18) that have been coupled or meshed with each other are fused together over a predetermined length of the row of loops at one end of the fastener 10 as by means of a supersonic processing and cut closely along a longitudinal inner edge of each of the sewn seams 19 to provide a pair of integrated pin members 20 and 21 on opposed stringers 11 and 12, respectively. Fusing the plastic monofilament element 15,(16) causes its stock to melt and penetrate into the interstices of the fabric forming the sewn seam 19, reinforcing core (33) and support tapes 13,14, with the results that all of these parts of the fastener 10 are intimately united. The pin members 20 and 21 that result from cutting or removing portions of the fused region of the stringers 11,12, of which a first portion 22 extends longitudinally closely along and substantially in parallel with the inner edges of the respective sewn seams 19, with the coupling head portions 17*a*,(18*a*) of the element 15,(16) completely removed. A second portion 23 of the fused and cut region is tapered off with a plurality of coupling heads 17*a* of the successive loops 17 on the stringer 11 transferred to and anchored between adjacent ones of the successive loops 18 on the opposite companion stringer 12, or vice versa, as shown in FIG. 2. The cutting takes place in the second portion 23 so that the first meshing or terminal loops 17',18' remain under formed. The coupling head 18*a'* in particular which has been transferred by cutting of the second portion 23 of the fused region from one stringer 12 to the other stringer 11 is fused integrally with the first meshing or terminal loop 17' on the stringer 11 so as to mechanically strengthen this loop 17', which would otherwise be unstable, and further hold the same in the proper meshing position with respect to the mating first meshing or terminal loop 18' on the stringer 12, so as to prevent "over-running" of one stringer 12 relative to the other stringer 11 when the second pin member 21 is inserted into a slider S as shown in FIG. 2. The correct intermeshing of the two opposed first loops 17' and 18' thus provided ensures smooth coupling of the respective stringers 11,12 without rupture or separation of the element chains.

Figure 5A:
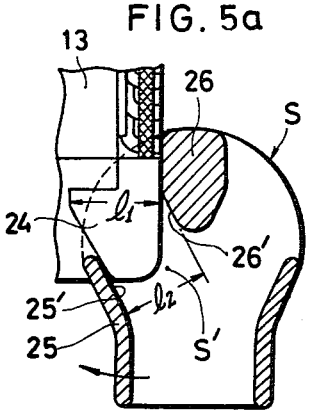
FIGS. 5*a*–5*e*, inclusive, are views utilized to explain the manner of mounting a slider on one of the fastener stringers.
Figure 5B:
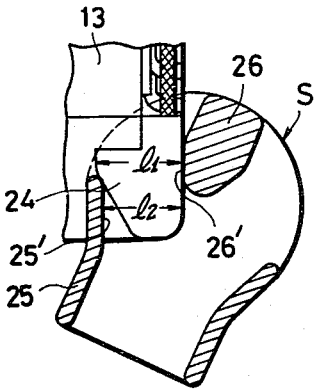
Figure 5C:
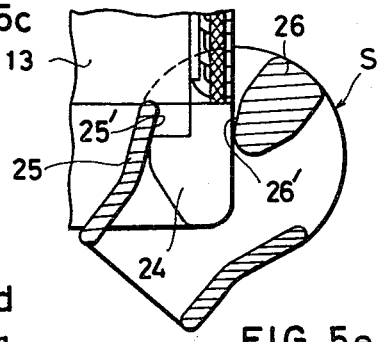
Figure 5D:
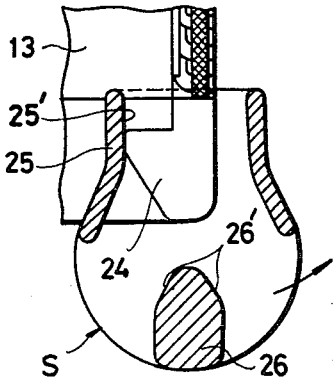
Figure 5E:
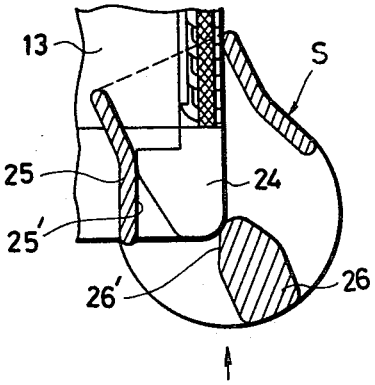

One of the paired pin members or a slider-lock pin member 20 includes a locking lug 24 which is formed integrally therewith at the lower-most end of the stringer 11 for locking engagement with the slider S. The locking lug 24 has a straight marginal edge 24*a* coextensive with the edge of the first cut-out portion 22 on the stringer 11, a curved peripheral portion 24*b* and a locking surface 24*c* extending transversely of the stringer 11 for abutting engagement with the end of one of the flanges 25,25 of the slider S. To provide effective locking of the locking lug 24 with the slider S, the width or transverse length $l_1$ of the lug 24 is calculated to be substantially equal to or slightly greater than the distance or spacing $l_2$ between one of the flanges 25,25 and a diamond 26 of the slider S; more specifically between a flared flange portion 25' and an inclined diamond surface 26', defining therebetween one of the branched guide channels S' of the slider S, the arrangement being that when threading the stringer 11 thorugh the slider S progressively from the position of FIG. 5*a*, then the position of FIG. 5*b* to the position of FIG. 5*c*, the locking lug 24 undergoes slight elastic deformation in frictional contact with the flange 25 and diamond 26 of the slider S as the lug 24 is moved into the slider S through rotation only in the plane of the fastener 10. The stringer 11 may be further threaded through another slider S in the manner shown in FIGS. 5*d* and 5*e* in the case where the fastener 10 is desired to be reversibly opened and closed with use of two sliders S as is well known in the art.

Each of the pin members 20,21 is provided with a linear reinforcing guide portion 20',(21') formed by deformation of the heel or turn portions 17*d*,(18*d*) simultaneously with the fusing of the element 15,(16), which guide portion 20',(21') facilitates the insertion of the stringer 11,(12) with least frictional resistance through the slider S.

The other or inserting pin member 21 has a rounded inner peripheral surface 21*a* engageable with the diamond 26 of the slider when the stringer 12 is threaded through the latter, in which position the first meshing loop 18' on the stringer 12 is brought into engagement with the first meshing loop 17' on the mating stringer 11 in the space between the loops 17' and the next adjacent one of the successive loops 17.

Designated at 27 is a reinforcing plastic film enveloping the lower end portions of the respective stringers 11,12, which serves to prevent fraying of the threads of sewn seam 19, support tapes 13,14 and reinforcing core and at the same time to facilitate finger-gripping of the stringers 11,12 when threading the latter through the slider S.

Referring now to FIG. 1, the description proceeds with the method of the invention for the manufacture of the above-described separable slide fastener, in which a continuous length of coupled stringers or a fastener chain F is subjected to a supersonic processing whereby the fastener chain F is fused, shaped and cut out over a predetermined length W of successive fastener elements 15,16. Upon thermal fusion of the rows of successive loops 17,18 while in intermeshed condition, the thermoplastic material constituting the loops 17,18 is molten and united integrally with the fabric material constituting the longitudinal edge portion of each of the support tapes 13,14 to which the loops 17,18 are secured. The fused element length or region W of the fastener chain F is shaped by means of a suitable die (not shown) so that the heel or turn portions 17*d*,18*d* of the successive loops 17,18 are merged together and shaped into the linear reinforcing guide portions 20',21'. At the same, there is formed a composite pin-forming structure 28 located centrally of the fused region W and contiguous to the shaped guide portions 20',21'. The structure 28 is then cut out to produce a multi-form aperture 29 having a center point 30 across which the slider-lock pin member 20 and the inserting pin member 21 on one stringer 11 are situated in point-symmetry relation to similar slider-lock and inserting pin member on the other stringer 12. The multi-form aperture 29 has a pair of horizontally extending (transversely of the fastener) bay portions 29*a*,29*a* disposed oppositely across the center point 30 and a pair of vertically extending (longitudinally of the fastener) elongated canal portions 29*b*,29*b* defined by substantially parallel marginal edge lines 31,32 extending closely along the sewn seams 19 of the respective stringers 11,12. The ends of the paired canal portions 29*b*,29*b* opposite to the center point 30 are tapered off and biased in opposite directions as at 29*b'*,29*b'*.

Figure 4:
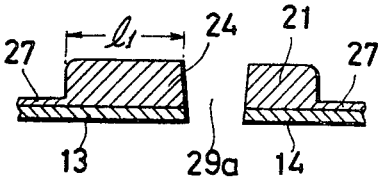
FIG. 4 is a cross-sectional view taken on the line IV—IV of FIG. 1.
Figure 3:
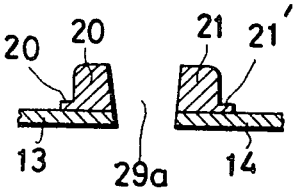
FIG. 3 is a cross-sectional view taken on the line III—III of FIG. 1.

The fastener chain F is then severed along a line extending transversely of each of the support tapes 13,14 in registry with the bay portions 29*a*,29*a* thereby subdividing the composite structure 28 into two identical pairs of slider-lock pin members 20 and inserting pin members 21 at the respective severed ends of the stringers 11,12, each of the pin members 20 and 21 having the form and function which has been already described in connection with FIGS. 2 through 4.

Figure 6:
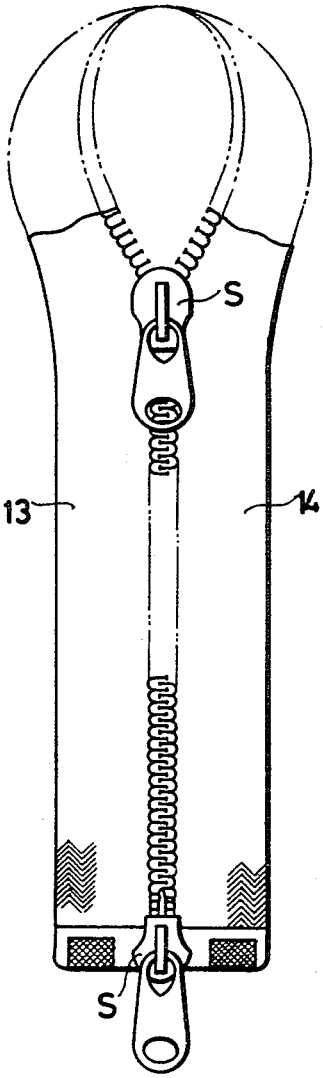
FIG. 6 is a plan view of a loop fastener provided in accordance with the invention.

FIG. 6 is illustrative of the principles of the invention which may be readily applied to a so-called loop fastener.

Figure 8:
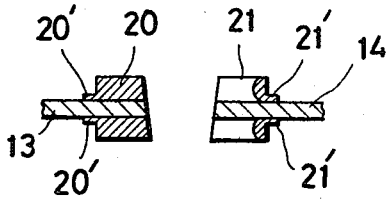
FIG. 8 is a cross-sectional view taken on the line VIII—VIII of FIG. 7.
Figure 9:
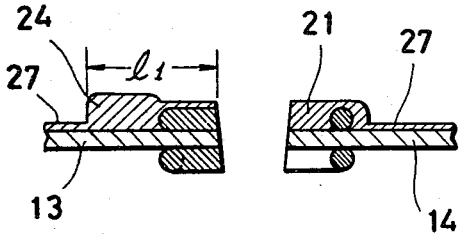
FIG. 9 is a cross-sectional view taken on the line IX—IX of FIG. 7.
Figure 7:
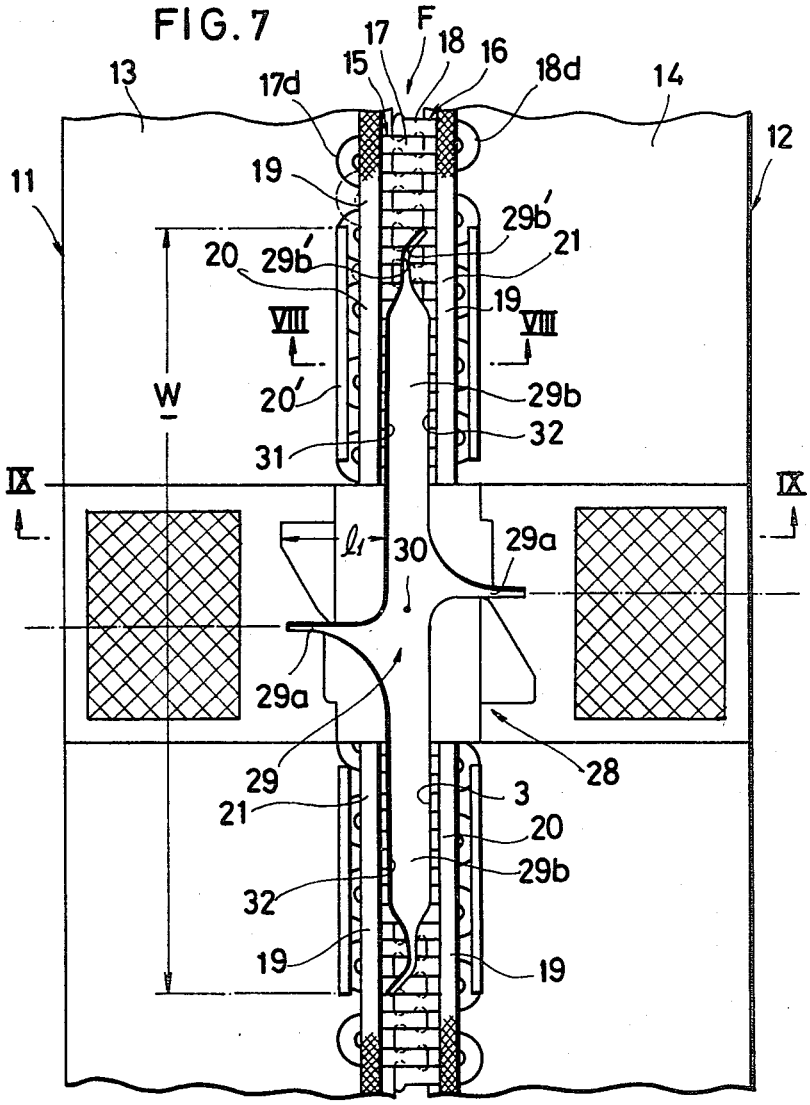
FIG. 7 is a view similar to FIG. 1 but showing another embodiment of the invention.

FIGS. 7 through 9, inclusive, are illustrative of the embodiment of the invention which is the same except that the fastener element 15,(16) is in the form of a meandering or zig-zag structure.

Although various minor modifications may be suggested by those versed in the art, it should be understood that I wish to embody within the scope of the patent warranted hereon, all such embodiments as reasonably and properly come within the scope of our contribution to the art.

What is claimed is:

1. A separable slide fastener chain comprising a pair of oppositely disposed stringers of continuous length each having a support tape and a fastener element formed from a plastic monofilament into a continuous structure having coupling head portions and secured by sewn seams to a longitudinal inner edge of the respective tape, said fastener element being fused together over a predetermined length of the two coupled stringers at predetermined intervals, and a composite pin-forming structure located centrally of the fused length of the fastener element and cut out to produce a multi-form aperture having a pair of bay portions extending transversely of the fastener chain and oppositely disposed in point-symmetry relation and a pair of elongated canal portions extending longitudinally closely along the sewn seams, said composite structure being subdivisible across said bay portions into two identical pairs of slider-lock pin members and inserting pin members.

2. A separable slide fastener chain as claimed in claim 1 wherein said canal portions are tapered off and biased in opposite directions with the coupling head portions of the fastener element being transferred from one stringer to the other stringer.

3. A method of producing a separable slide fastener chain comprising a pair of oppositely disposed stringers of continuous length each having a support tape and a fastener element formed from a plastic monofilament into a continuous structure having coupling head portions and secured by sewn seams to a longitudinal inner edge of the respective tape, which method comprises fusing a predetermined length of said fastener element integrally with said tape edge, shaping a composite pin-forming structure and cutting said structure through a multi-form aperture having a pair of bay portions extending transversely of the fastener chain and oppositely disposed in point-symmetry relation and a pair of elongated canal portions extending longitudinally along the sewn seams and having tapered end portions adapted to transfer the coupling heads from one stringer to the other stringer, said composite structure being subdivisible into two identical pairs of slider-lock pin members and inserting pin members by a line of cut extending transversely across the tapes in registry with said bay portions.

4. The method as claimed in claim 3 further comprising biasing said tapered end portions in opposite directions such that a terminal meshing element loop on each stringer remain underformed.

* * * * *